United States Patent [19]

Brundage

[11] 4,194,181

[45] Mar. 18, 1980

[54] HOTEL ROOM STATUS MONITOR AND POWER CONTROL SYSTEM

[75] Inventor: Bert W. Brundage, Columbus, Ohio

[73] Assignee: Efficiency Systems, Inc., Grove City, Ohio

[21] Appl. No.: 855,184

[22] Filed: Nov. 28, 1977

[51] Int. Cl.[2] ..... G08B 5/00

[52] U.S. Cl. ..... 340/286 R; 340/310 A

[58] Field of Search ..... 340/310 A, 286 R

[56] References Cited

U.S. PATENT DOCUMENTS

| | | | |
|---|---|---|---|
| 2,305,862 | 12/1942 | Gilliver | 340/310 A |
| 3,228,020 | 1/1966 | Gassenheimer | 340/286 |
| 3,254,335 | 5/1966 | Staten | 340/286 |
| 3,424,919 | 1/1969 | Howlett | 340/310 A |
| 3,694,810 | 9/1972 | Mullens | 340/286 |

*Primary Examiner*—Harold I. Pitts
*Attorney, Agent, or Firm*—Robert E. Stebens

[57] ABSTRACT

A system is provided for facilitating monitoring of the status of numerous rooms in a hotel or motel by the desk clerk and enabling control by the desk clerk of availability of electrical power to any specific room. This system includes a monitor and control panel located at the registration desk for control and observation by the desk clerk. This monitoring panel includes the control circuitry which is coupled with an indicator panel at the housekeeper station and an operating circuit associated with the electrical power system to the several rooms. Also included is a housekeeper operated switch mechanism located in each of the respective rooms and operatively coupled with the other components of the system and which switch mechanism is selectively operable by the person entering a room for purposes of cleaning to override the desk clerks control as to availability of electrical power in that room and signal the desk clerk as to that fact.

8 Claims, 7 Drawing Figures

HOTEL ROOM STATUS MONITOR AND POWER CONTROL SYSTEM

BACKGROUND OF THE INVENTION

This invention is directed to the hotel and motel industry and having as objective, providing of a more expeditious means of maintaining an instantly available and accurate monitoring of the status of any number of the rooms in the particular establishment. The general practice and procedure in hotels, and by the term hotels it is intended to include motels or other types of room rental businesses and establishments, for monitoring of the status of a room as to being occupied, unoccupied or in a state of cleaning, has been effected through the means of personal communication between the housekeeper and the desk clerk and may include telephone communications. This personal communication also necessarily involves the communication as between the several personnel of the housekeeping staff and thus the systems, as heretofore employed necessarily resulted in a substantialy delay and often inaccurate representation to the desk clerk as to the availability or the status of any particular room.

Additionally, the controls afforded the desk clerk over any of the rooms, have been limited to dispatching of a person to personally check the status of the room and to control the operation of equipment that may be placed in that room. Specifically, the equipment of substantial concern includes the heating and cooling equipment as well as the lights and other large electrical power consuming apparatus such as the television set. Again, this personal checking necessitated a substantial delay in obtaining the information and consequent inaccuracy of that information. It is quite clear that once a person departed the room after checking on the status, the status of the room could subsequently change without knowledge of the desk clerk or housekeeper and this could result in embarrassment to the desk clerk as to the availability or nonavailability of a particular room. Also, the prior personal checking systems enabled persons to continue occupancy of a room undetected by the desk clerk and thus deprive the hotel of earned revenue as well as continued expenditure of money for the electrical power requirements for the operation for that room.

An important aspect of hotel operation is the economic utilization of resources. One very important factor and element of such resources and economics is the utilization of electrical power. Most equipment in modern hotels is now opearated by electrical power and this includes equipment such as the heating and cooling equipment. Most hotels are now constructed to have individual heating and cooling units for each room and these are necessarily controlled at that room. Consequently, the conservation of electrical power requires turning off all unused apparatus, such as the lights and television sets that are normally included in a hotel room. Guests very frequently leave the room with the heating or cooling equipment operating as well as numerous lights and often leave the television set operating. Thus, it will be readily apparent that the continued operation of these devices in the absence of a registered occupant represents an unnecessary waste and material cost factor to the hotel operator in the economics of hotel management. That the use of electrical power when a room is not occupied by a registered guest represents a substantial cost will be clearly apparent when it is noted that the occupancy time in normal one day stay represents only about one half day. This continued use of electrical power as for unnecessary heating or cooling is a very significant cost factor.

Also, as indicated, control over the room and monitoring of its status as well as its occupancy is a matter of substantial concern and is necessary for obtaining of proper revenue from hotel operation. Many times occupants have a tendency to return to a room for continued occupancy for a short period of time beyond that of the specified checkout time. This characteristic has resulted in embarrasement at times to the desk clerk for the subsequent assignment of such a room to other registered occupants. The difficulty is that the new occupants upon arrival at the room find that it is already occupied and become extremely concerned that the desk clerk has made a mistake when in fact the desk clerk has the proper information that the room should be unoccupied. The difficulty of the personal communication system, as previously described, is that the desk clerk is unable by any reasonably economic means, to assure himself that the room is in the indicated unoccupied state, which indication is based on the fact that the guest had checked out at the registration desk.

Furthermore, the personal communication system that has been necessitated by previous management procedures is slow and is an inaccurate reporting system between the housekeeper and the desk clerk. One disadvantage is that the desk clerk is unable to rapidly communicate to the housekeeping station that a particular room has now arrived at an unoccupied status and is thus requiring the complete cleaning and readiness for a subsequent registered occupant. A second disadvantage is that the housekeeper, upon the maids having completed the assigned duties of cleaning and readying the room, is unable to readily communicate this fact to the desk clerk as the maids require a certain amount of time to advise the housekeeper and then there is further delay in relay and transfer of information to the desk clerk.

SUMMARY OF THE INVENTION

The hotel room status monitoring system and power control system provided by this invention comprises an integrated system wherein control of the functional operation as to the electrical power supplied to a particular room may be selectively controlled as between a switch located in the room itself, and is only operable by a specific keying device, and a monitoring and control panel located at the desk cleark's station which is operable by the desk clerk. In accordance with this invention, the several rooms which are generally individually provided with electrical power through separate and independent circuit breakers, have a further control incorporated in the power sustem consisting of remotely controlled power circuit relays. These relays are interconnected into the control system for obtaining the necessary control as to the supply of power from either the keyed room switch or the desk clerk's panel. A separate relay is provided for each of the room power circuits or power circuit breakers and is connected in circuit therewith to provide the necessary power control. In addition to the power control relays which are arranged in a compact panel, a secondary control circuit panel is provided and positioned in closely adjacent relationship thereto. This secondary control circuit panel includes the components that effect the control of the several relays.

A signaling panel is located at the housekeeper's station for advising the housekeeper of the necessity for cleaning of any particular room. This panel includes a separate indicating light for each of the respective rooms with the operation being that the light will be illuminated at the command of the desk clerk to indicate that a room has now been vacated and requires cleanup for a subsequent occupant.

The control system is preferably operable on low voltage electrical power that advantageously utilizes direct current of the order of five volts. This power control system thus avoids the dangers inherent in high voltage systems such as that which are required for the normal electrical power necessary for operation of the heating or cooling units in a room, lights and television. Furthermore, the control system in utilizing a low voltage direct current incorporates an isolating switch mechanism as between the control system and the power relays to prevent any cross over of signal between the two units that could either result in interference in a telephone system or otherwise present an electrical shock hazard that may injure personnel.

The control and monitoring panel located at the desk clerk's station includes four status indicating lights and a set of three electrical switches which are selectively operated by the desk clerk in controlling the functions of the system. The system is also responsive to the key-operated switch located in each room and which is selectively actuated by a housekeeper or maid during the performance of the cleaning operations. This monitoring panel at the desk clerk's station includes a set of the switches and lights for each of the respective rooms that are included in the hotel, or a selected portion of those rooms which are subject to control and supervision by a particular desk clerk, Appropriate circuitry is incorporated in the monitoring panel to enable the desk clerk to signal the housekeeping station as to the necessity for cleaning of a room and to also disconnect the electrical power from that room thereby enabling the desk clerk to control the utilization of electrical power in any one of the rooms. It is this control of the electrical power by the desk clerk that enables this system to provide the economy of operation in the saving of electrical power. The control functions available to the desk clerk include a switch which is actuated by the desk clerk at the time an occupant checks out of the hotel. This switch is operated at that time and effects a turn-off of all electrical power to the particular room as well as signalling of the housekeeper by means of the indicator light for that respective room.

The key type electrical switch mechanism in each of the rooms, which switch mechanism is operable by the housekeeper or maid, provides a means for effecting monitoring and control of the room cleaning operation as well as enabling the maid to energize the electrical power circuits in the room for use of the cleaning equipment. The key mechanism being of a limited and controlled nature, assures that a housekeeper or maid will not continuously remain in a single room or keep a single room open and have the electrical power available and utilized for an unnecessary length of time without being subject to the supervisory control of the desk clerk,. This presents a further aspect in the economic supervision of hotel management procedures. Since the desk clerk is advised of the time when a housekeeper does arrive at a room for cleaning, the desk clerk is thus enabled to maintain supervision of the time required for the room to be cleaned.

Upon completion of any cleaning operation, an automatically functioning circuit and light signalling system included in the control system will indicate to the desk clerk that the cleaning operations have been completed. This automatic function of the system is initiated upon the housekeeper's or maid's removal of the switch keying mechanism from the switch located in a particular room. Concurrently with the signalling of the desk clerk that the room cleaning has been completed and that the room is now available for occupancy, the electrical poer of the room is again cut off to continue the power conservation procedures. At the time that the desk clerk again registers a guest for a particular room, the desk clerk operates the switch mechanism at the monitoring panel to restore electrical power to the room and thus enables the occupant to utilize the heating and cooling equipment, lights and television set placed within that room. This situation as to the occupancy of the room and the power is indicated by the monitoring panel for continuous supervision by the desk clerk.

A further inherent control which is effected by this system is that should any previously registered guest retain a key and desire to prolong a stay beyond the scheduled checkout time and having checked out through the desk clerk, the system will result in the desk clerk probably being advised by that guest of the fact that he has again entered the room. The reason that the desk clerk will be apprised of this fact is that having once checked the guest out of the room, the return of the previously registered occupant will most likely inititate a telephone call to the desk clerk asking about the resumption of electrical power for the room. This will necessarily alert the desk clerk that the occupancy has continued without authorization and thus prompt his further personal investigation of the situation. A further advantage of this is that there will be no time subsequent to the checkout that the electrical power will be continued to be utilized in the room without knowledge of the desk clerk. This includes the time during which the maid is cleaning the room and subsequently indicates to the desk clerk that the operation has been completed.

These and other objects and advantages of this invention will be readily apparent from the following detailed description of an illustrative embodiment thereof and the accompanying drawings.

DESCRIPTION OF THE DRAWING FIGURES

DESCRIPTION OF THE ILLUSTRATIVE EMBODIMENT

Figure 1:
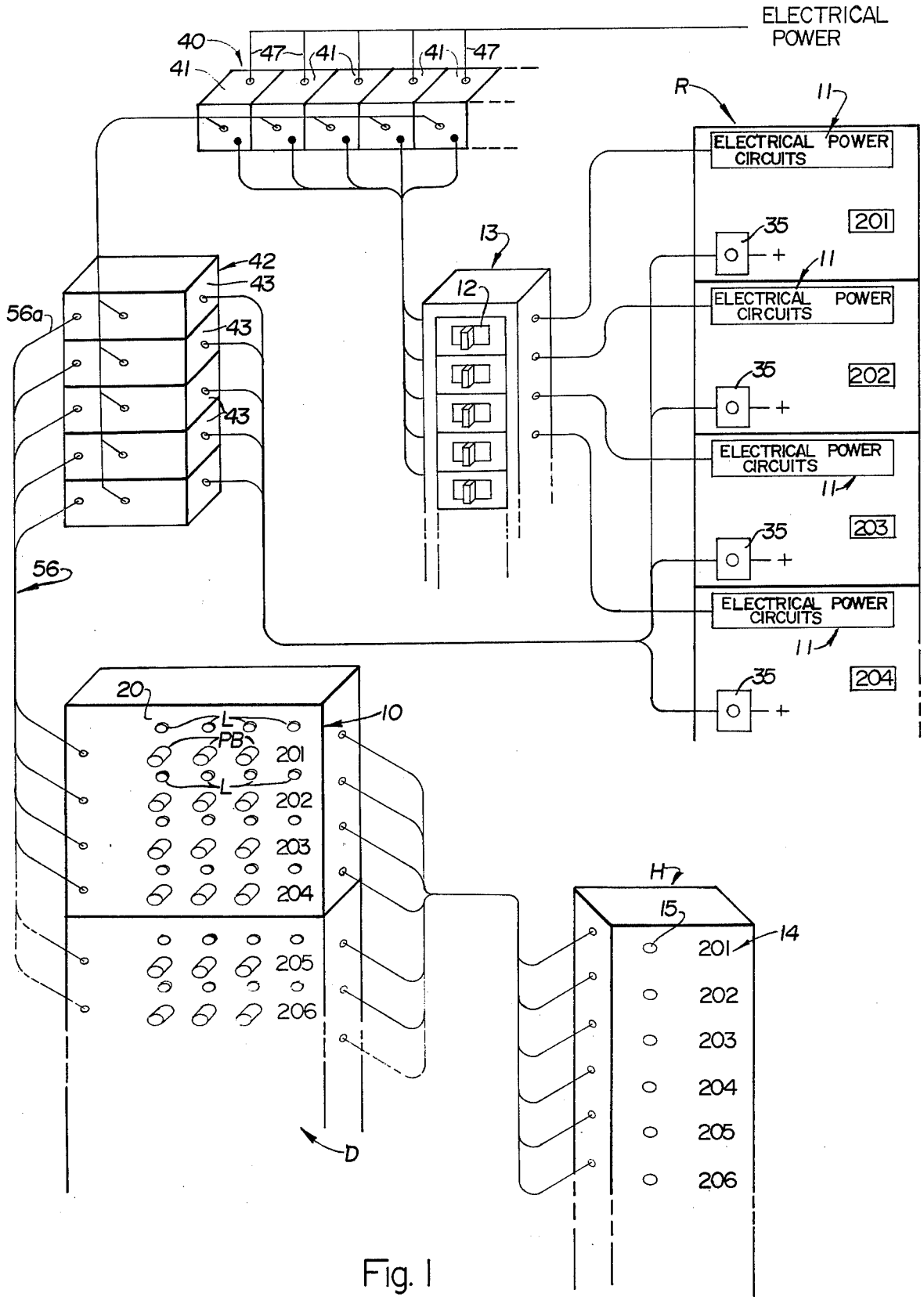
FIG. 1 is a diagrammatic illustration of the control system and components thereof incorporated in a diagrammatically indicated hotel room environment.

Having reference specifically to FIG. 1, an installation incorporating the novel room status monitor and electrical power control system of this invention is diagrammatically shown situated within a hotel environment. Specifically, the system includes a registration desk or desk clerk station D, a housekeeper station H, and a plurality of room units R. The desk clerk station D, while not otherwise illustated in any detail, is located at or in the near vicinity of the conventional registration desk for a hotel or motel and includes a monitor and control panel 10. This panel 10 is preferably conveniently located within easy visual and operative relationship to the desk clerk in the performance of his duties in the checking out and checking in of guests for the several room units R. The room units R would be oriented and arranged in an architecturally designed advantageous manner for a particular operation and, in FIG. 1, the hotel is only diagrammatically illustrated as comprising four such units. It will be understood that a substantially greater number of room units would be included in a hotel and the system is shown as being designed for accommodation of a substantially greater number of room units.

Each of the room units R is understood to also include the usually provided equipment and apparatus such as a heating unit or combined heating and cooling unit, numerous electrical lamps or lighting fixtures and electrical power outlets for appliances such as a television set. Electrical power is supplied to each of the room units in the diagrammatic illustration of FIG. 1 by an electrical power circuit generally indicated by the block identified by the numeral 11 with this circuit for each of the rooms being independently controlled through its own circuit breaker 12 with the several breakers for a set or group of rooms shown mounted in a common electrical panel 13. The circuit breaker panel 13 would be of a size to accommodate the necessary number circuit breakers 12 for a predetermined number of rooms and is preferably located in relatively close proximate relationship to those particular controlled room units R. The electrical wiring is diagrammatically shown for interconnecting the respective electrical power circuits 11 with the associated circuit breaker 12. In a conventional system, a primary electrical power source is then connected to the opposite side of the circuit breakers 12 for supplying of the necessary power to each of the room units.

Also provided for each of the groups, or predetermined number of room units, is a housekeeper station H for achieving the necessary control and supervision for the personnel involved in cleaning and making up the room units. For this purpose, in accordance with this invention, an indicator light panel 14 is provided at the housekeeper's station for supplying the necessary information to the supervisory housekeeper. This panel includes a number of indicator lights 15 which are physically associated with an indentifing numeral that corresponds with the respective room unit R. This association of the lights and the room units is indicated by the numerals 201 through 205 to provide an indication of this particular relationship. It will be recognized that FIG. 1 is only illustrative of a representative number of room units R and corresponding number of indicator lights 15 at the housekeeper station H and that the housekeeper's indicator panel 14 would be provided with as many lights and identifying the numerical indicia as the housekeeper station would have room units R assigned for cleaning and maintenance.

Figure 2:
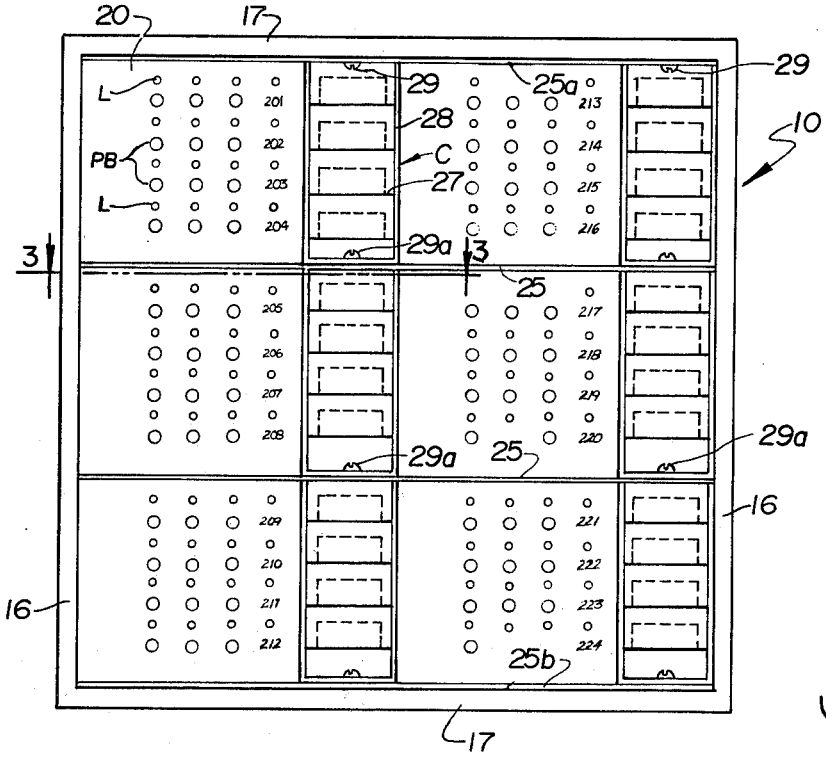
FIG. 2 is an elevational view of the desk clerk monitoring panel.
Figure 4:
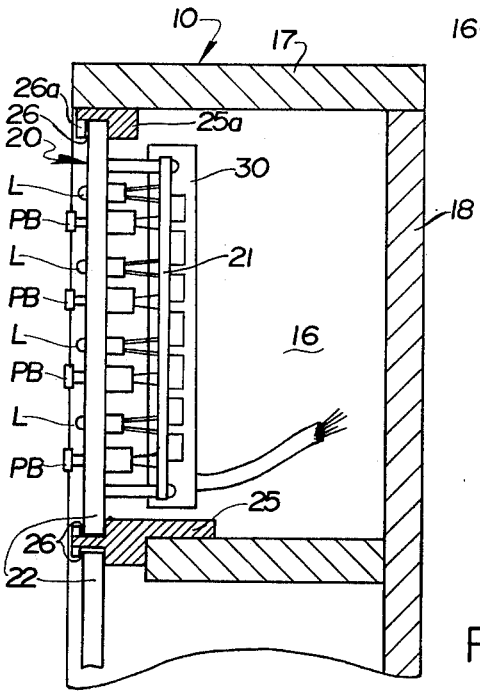
FIG. 4 is a fragmentary vertical sectional view taken along line 4—4 of FIG. 3.
Figure 3:
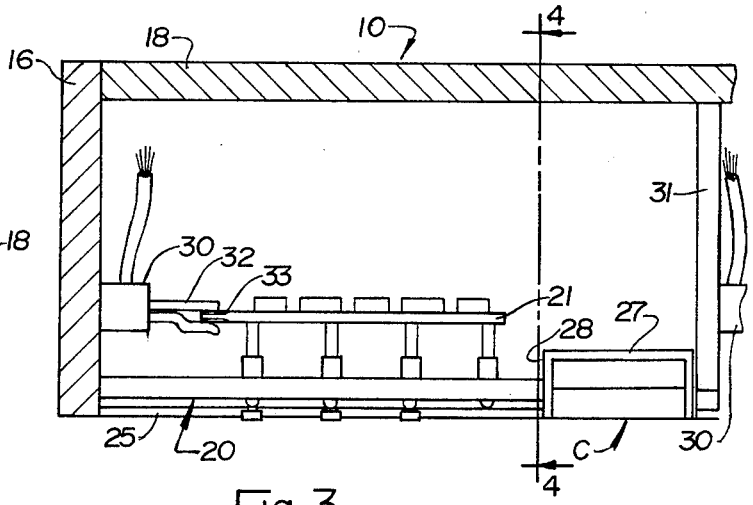
FIG. 3 is a fragmentary horizontal sectional view on an enlarged scale taken along line 3—3 of FIG. 2.

A more structurally detailed illustration of the desk clerk's monitor and control panel 10 is shown in FIG. 2 with FIGS. 3 and 4 being sectional views thereof to further illustrate a particular mechanical construction. This panel comprises a structural frame including vertical side members 16 and horizontally disposed top and bottom members 17. For a more complete structure, this panel may also include a rear mounting panel 18 with suitable fastening means (not shown) provided for securing the panel 10 in the associated structural arrangement of the desk clerk's station. Such mounting and positioning is not of any material significance to the disclosure of this invention and such details are therefore omitted for simplicity.

In accordance with this invention, the control and monitor panel 10 comprises a number of modular panel units 20 of interchangeable configuration and which are designed to accommodate and provide the necessary control and monitoring for a specified number of room units. In this illustrative embodiment, each such modular panel unit 20 is designed to accommodate four room units. Consequently, the control panel 10 would be provided with as many of these panel units 20 as determined by the number of room units R included in the hotel or motel, or which would be assigned to a specific desk clerk station. These panel units 20, which provide the control and monitoring for a specified number of rooms, include indicator lights and control switches which are designed to be actuated from the front of the panel by the desk clerk. Also provided with each unit is an electrical circuit board 21 which carries the various electrical components incorporated in the control circuit of each unit and is mechanically secured to a structurally supporting board or display panel 22. The several electrical switches which are of a push-button type PB project through the panel 22 for operation by the desk clerk along with the several indicator lights L which are disposed in respective apertures to facilitate visual observation by the desk clerk. In general, the several push-button switches are designated by the letters PB and the lights for indicating the room status are indicated by the letter L. It will be noted that appropriate numerical subscripts are added to each of the indicia and these will be related to the specific circuit description.

Physical mounting of the several modular units 20 in the control panel 10 is effected by horizontally extending support rails 25 which are secured at opposite ends to the vertical sidewalls 16 of the panel. The support rails 25, located at the intermediate portions of the panel, comprise both upwardly and downwardly opening channels 26 which are appropriately dimensioned to receive the display panels 22 of each respective modular panel unit. It will be understood that the upper and bottom horizontal walls 17 will be provided with modified support rail **25*a* and 25*b* having only a downwardly or upwardly opening channel for receiving the top or bottom marginal edge of a respective modular panel units 20** disposed in the upper or lowermost row.

It will be noted that the several push-button switches PB and associated indicator lights L are arranged in horizontal and vertical alignment to provide a uniform relationship as to the specific function and indicators for each room unit. To further aid in providing the desk clerk with information necessary for performance of the normal room registration functions, card racks C are provided in the panel 10 with these racks designed to accommodate an information card for a particular room. In the usual hotel practices, the desk clerk makes up a card for each registered guest upon registration and these cards are arranged in a rack which is physically arranged to visually correspond with a numerical room designation. In this instance, racks C comprise a plurality of multiple card units 27 that are of the same general construction. Each of the card units 27 is adapted to receive four cards C' and are each mounted in the control panel 10 in side-by-side relationship to a respective modular panel unit 20 for a specified group of rooms. Accordingly, each card unit 27 has the four vertically spaced, horizontal receptors for the cards C' arranged in horizontally aligned relationship to the switches and indicators for that particular room. Preferably, the card units 27 are mechanically secured in the panel to also function as a means for locking the respective panel unit 20 in the panel structure. This arrangement is desired as it will prevent the panel units 20 which are of a modular, interchangeable design from being readily removed by unauthorized personnel. Consequently, the card units 27 include a frame 28 which is insertable into a section of the upwardly opening channel 26 of a support rail and have an upper end thereof secured either to the top horizontal wall 17 of the panel 10 by a fastening device 29, or to a rail 25 by a screw type fastener 29*a*. To facilitate removal of the modular panel units 20, each of the rails 25 has the channels 26 formed with a cutout portion 26*a* in the region of the card rack and thus permit the panel 22 to be slid longitudinally in its respective channels to this cutout and then, through lateral displacement, withdrawn from the support rails. Each of the panel units 20 is thus adapted to be readily replaced by a reverse sequence of operations with the last event being the replacement of the card units 27 and securing of that unit in its respective location. The frame 28 of the card unit thus projects against an end of a respective display panel 22 and maintains that panel in its supporting channels.

Electrical power and control circuitry is interconnected with the respective circuit board 21 by utilization of conventionally available multi-contact connector blocks 30. These connector blocks 30 are mechanically secured and mounted on either the side walls 16 or other suitable supporting brackets 31 and provided with spring-type electrical contact fingers 32 projecting laterally to receive a cooperative terminal contact strip 33 formed on an end portion of the circuit board 21. The spring contact fingers 32 are shown with the terminal contact strip 33 of the board shown inserted in those contact fingers as best seen in FIG. 3.

Figure 5:
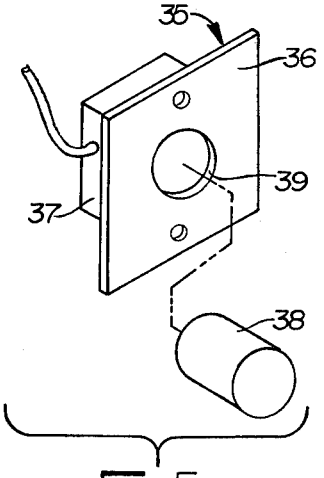
FIG. 5 is a perspective view of the housekeeper operated room switch and magnetic key mechanism therefore.

The housekeeper and other personnel associated with that function are provided with limited control over operation of the system in accordance with this invention. This limited control is achieved through an electrical switch 35 which is located in each of the several room units R. This switch 35, which can be mounted at any suitable location in a room unit, includes a mounting plate 36 and carries a magnetically actuated electrical switch mechanism which is indicated at 37 with the physical structure shown in FIG. 5. In accordance with this invention, the switch 35 is of a type which is responsive to a magnetic field for its selected operation to restrict the utilization and operation of the switch to only authorized personnel, having a key element 38 that is of a particular design to cooperate with the switch. Accordingly, the switch mounting plate 36 is provided with a key receiving aperture 39. The key element 38 would be provided on recorded assignment to the housekeeper or other person that is assigned to clean and maintain the rooms. Placing the key element 38 in the aperture 39 would result in maintaining the key in association with the switch 35 for its operation until such time as the person again physically removes the key element. Operation and functioning will be further described in relationship to the specific electronic circuitry.

As previously indicated, electrical power is supplied to the circuits 11 in each of the respective room units R through an interconnected circuit breaker 12 as mounted in the common panel 13. Providing of electrical power, in accordance with the system of this invention, is controlled through a relay panel 40 which includes a relay-type power switching device 41 for each of the room circuits and is interconnected in series between the circuit breaker 12 and the primary electrical power source. The several relay power switches 41 are only shown diagrammatically in FIG. 1 and only a small number are shown with the number corresponding to the illustrative number of room units R indicated in that drawing figure. Again, it will be understood that the number of relay power switches 41 included in a particular relay panel 40 will be in accordance with the number of room units R that are associated with that circuit arrangement.

Also provided in generally close proximate relationship to the relay panel 40 and circuit breaker panel 13 is a secondary control circuit unit 42. This control circuit unit 42 includes a number of separate and distinct secondary control circuits 43 that may be included in multiple circuit modules which may include four circuits 43. The total number of circuits 43 is equivalent to the respective room units R associated with the illustrative system.

The separate secondary circuits 43 are each independently interconnected through appropriate electrical conductor systems with respective portions of the panel units 20 at the desk clerk's station D and the room switch units 35. Also each of these secondary circuits 43 is electrically connected in controlling relationship to a respective one of the relay power switches 41. The various electrical connections, as between the several components, are only indicated diagrammatically as groups of conductors for simplicity of illustration. It will be understood that a substantial number of conductors will be required as between the panel units 20 of the desk clerk's control panel 10 and the secondary control circuit unit 42. However, it is possible to minimize the number of actual conductors that are required for a particular installation by electronic techniques which enable common use of a single conductor by more than one circuit. Placement of the secondary control circuit unit 42 in close proximate relationship to the circuit breaker panel 13, as well as the relay panel 41, eliminates the length of other control conductors and facilitates their installation. The present hotel and motel constructions rely on a central type passage or raceway for the placement of electrical wiring as well as other utility conduits. Thus, blocks of rooms, which would be normally associated with a particular circuit breaker panel 13, readily lend themselves to the incorporation and interconnection with the system of this invention.

Also, it is preferred that the control system be of a low voltage type to assure that there will be no electronic interference with other systems. Specifically, there is concern with respect to the telephone wiring when additional control circuitry is involved as interference may be readily developed. Consequently, the system of this invention is designed and constructed to utilize a low voltage direct current power which is of the order of five volts. This low voltage power is particularly adapted for use by transistorized and solid state control circuits that are embodied in the several circuits of this invention. A further advantage of the low voltage, direct current system is that the electrical shock hazard and fire hazard is essentially eliminated and thus does not present a further problem in the operation and safety of a hotel building.

Figure 6:
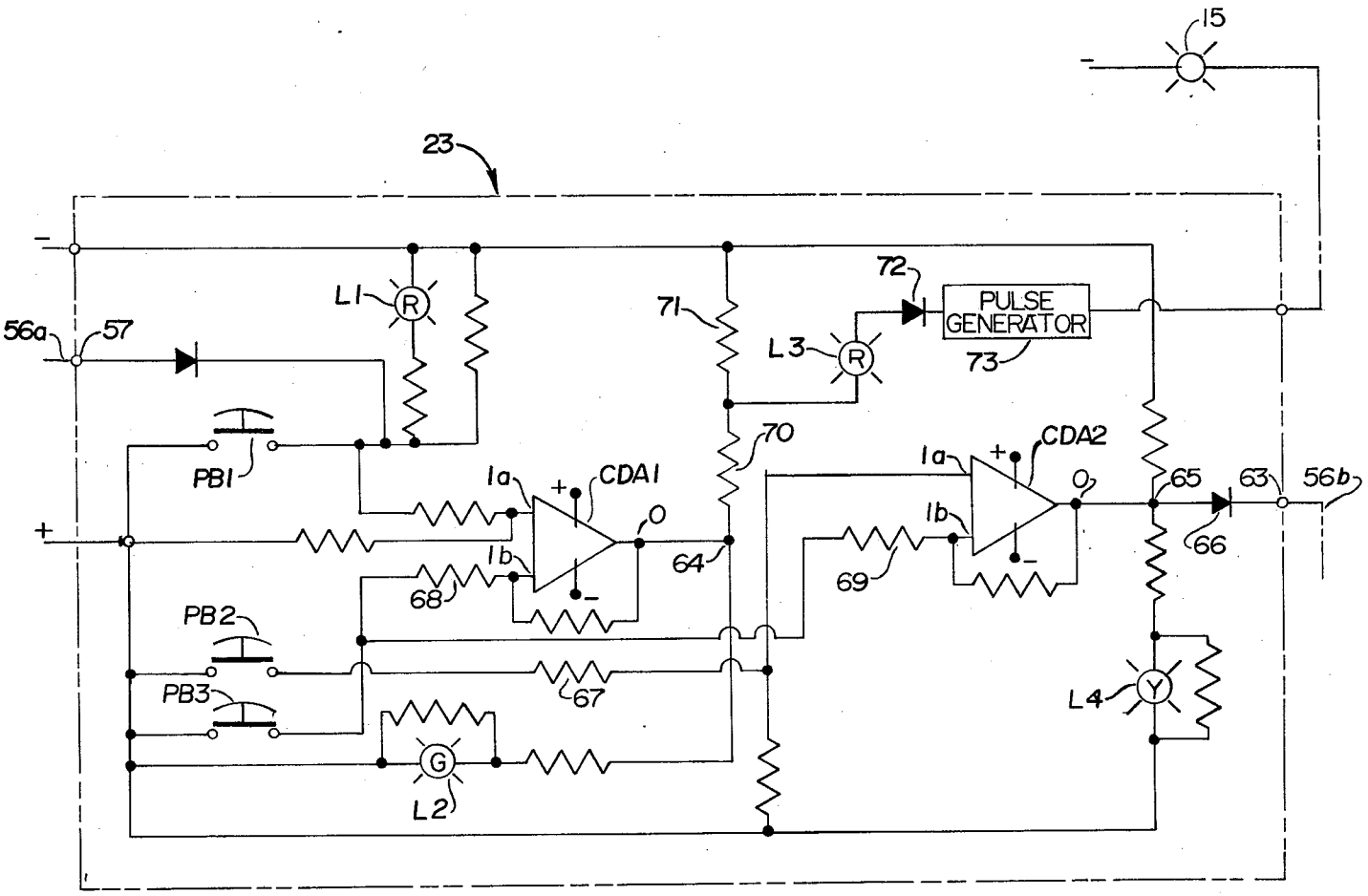
FIG. 6 is a detailed schematic diagram of the electrical control circuit for a particular room and embodied in the desk clerk control panel.
Figure 7:
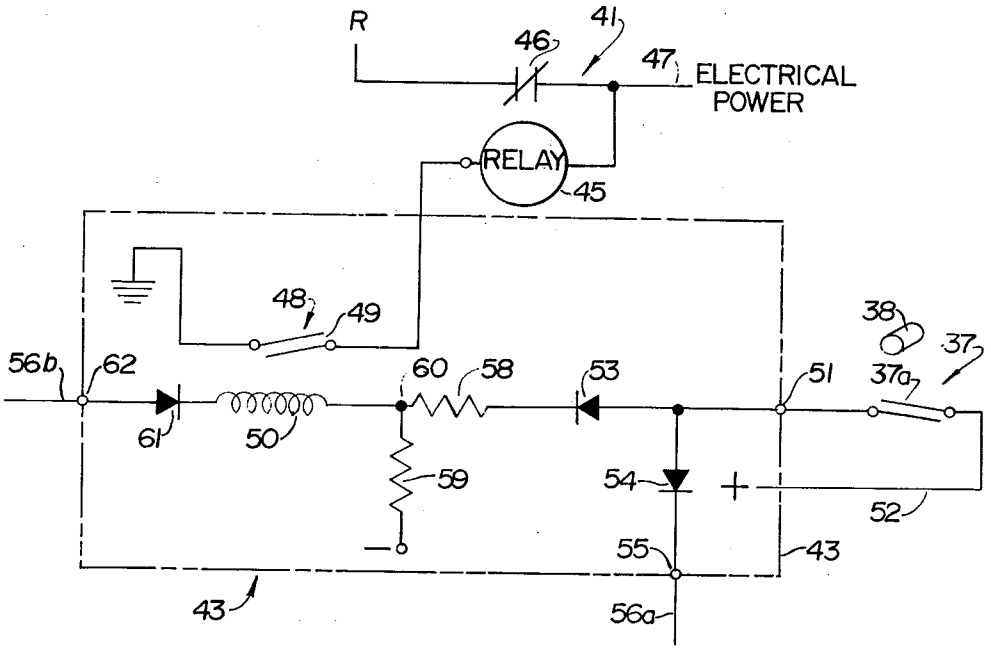
FIG. 7 is a schematic diagram of the secondary control circuit for a specific room as incorporated in the secondary control panel.

FIGS. 6 and 7 of the drawings illustrate the specific circuit schematics for the individual control circuits for a particular room unit R as included in the modular panel units 20 located at the desk clerk's station D and the secondary control circuit units 43. Considering first the secondary circuit 43 in FIG. 7, it will be noted that this circuit is interconnected with a relay power switch 41. That relay power switch 41 comprises an operating solenoid 45 which actuates a set of normally closed contacts 46 that are connected in the primary electrical power circuit. This primary electrical power circuit is shown as including a conductor 47 which extends from the power source through the relay contacts 46 and to the respective circuit breaker 12. As previously indicated, this circuit then continues to the respective electrical power circuit 11 of a particular room unit R. Operational control of the relay solenoid 45 is effected by a relay switch mechanism 48 which is included in the secondary circuit unit 43. This switch mechanism 48 is shown as comprising a normally open set of contacts 49 of a reed relay switch and its operating coil 50. The normally open contacts 48 are series connected with the relay solenoid 45 and thus affect control over the power relay 41.

Coupled with an input terminal 51 of the secondary circuit 43 is the magnetic switch 37 which is installed in the respective room units R. This magnetic switch 37 includes the normally open contacts 37*a* which are series connected between a low voltage (5 v D.C.) power source which is only diagrammatically illustrated by the positive sign and the interconnecting conductor 52. Included in the secondary control circuit 43 and connected with the input terminal 51 are a pair of diodes 53 and 54 with the diode 54 having its base connected to an output terminal 55. A conductor element 56*a* interconnects that output terminal 55 to an input terminal 57 of the primary control circuit 23 located in the modular panel unit 20 as shown in FIG. 6. The conductor element 56 is included in the groups of conductors that are similarly designated in FIG. 1 and which, as previously described, may include conductors that may be used for more than one circuit through electronic techniques to minimize the number of conductors required for the interconnection.

The other diode 53 connected to the input terminal 51 is series connected through a pair of resistors 58 and 59 to the negative terminal of the low voltage DC power source. The two resistors 58 and 59 are interconnected at a terminal junction which is designated 60 in FIG. 7. Series connected to that terminal junction 60 is the operating coil 50 of the reed relay switch which has its other end connected through a diode 61 to an input terminal 62. This input terminal 62 is also connected by a conductor element 56*b* of the group designated by the numeral 56 to an output terminal 63 of the primary control circuit, as shown in FIG. 6.

Referring next to FIG. 6, which illustrates a single primary control circuit 23 for a specific room unit R and is incorporated in the modular panel unit 20 that is provided with four such circuits, it will be noted that this circuit also has respective connections for interconnection with the positive and negative terminals of the low voltage DC power source. The particular interconnection and location of that power source is not shown in the several figures of the drawings but may be conveniently located in the area of the secondary control circuit unit 42. Accordingly, there would be electrical conductors that provide the necessary interconnection and would be included in the group of conductors designated by the numeral 56 interconnecting with the desk clerk's control panel 10.

Operation of the control circuit in effecting the automatic sequencing of the indications and monitoring of operations is effected by means of integrated circuit elements which are termed current differencing amplifiers with two such units incorporated in the circuit of FIG. 6. These elements are designated CDA1 and CDA2 and are each provided with drive power terminals indicated by the + and − polarity symbols for connecting with the low voltage power. These amplifiers are of a type that either provide or do not provide a voltage at an output 0 in accordance with application of switching signals applied at two input terminals Ia and Ib. The specific functions of these units will be explained during the course of the description of operation of the circuit which is believed to facilitate the understanding of the system and its advantageous features. Accordingly, the system will be described from the standpoint that the system has been placed in the condition where a specific room unit R is available for rental. It will be noted that each of the push button switches PB1, PB2 and PB3 is of a normally open type which is designed to be momentarily closed by the desk clerk in controlling and effecting monitoring of the hotel operations. The several indicating lamps are designated by the respective identifiers L1, L2, L3 and L4 as incorporated in the primary control circuit 23 of FIG. 6 and these lights may comprise light emitting diodes (LED) having low power requirements. For convenience of description, the housekeeper's indicator panel 14 will be concurrently considered and it will be noted that this panel also includes a respective indicator light 15 for each particular room. Interconnection of the circuit 23 with that indicating lamp 15 at the housekeeper's station H is shown in FIG. 6.

In this assumed starting condition, the circuit arrangement is such that the amplifier CDA1 is in a condition where its output at a terminal 64 is at a low state where the output of amplifier CDA2 at its terminal 65 will be in a high state. During the remainder of this description, the term low and high, with respect to the amplifiers, will be capitalized letters LO and HI. In this particular state of operation, the terminal 64 being LO will clearly indicate that power will then be applied to the indicator light L2 which is green and is utilized to signify to the desk clerk that the room is available for occupancy. With the terminal 64 being in a LO state and since it is effectively tied to a negative terminal of the power source, there will be no electrical power available for the indicating lamp L3 which is a red light and is utilized for indication of the necessity for cleaning of the room. This circuit associated with L3 is also series connected to the indicating lamp 15 at the housekeeper's station to provide the simultaneous indication at both locations when the circuit is operated to indicate the need for cleaning of that room.

Also in this assumed initial operating state, amplifier CDA2 is in a condition where the terminal 65 is in a HI state and this signal function is transmitted through a diode 66 to the input terminal 62 of the secondary circuit 43. In this situation, with the input terminal 62 having a relatively higher potential or voltage difference with respect to the terminal junction 60 that is tied through resistor 59 to a negative terminal of the power source, it will be seen that the reed relay operating coil 50 will be energized and result in closing of its associated contacts 49. Thus, with the reed relay switch 48 operated, the solenoid 45 of the power relay 41 will be energized and result in opening of its associated contacts 46. This in turn results in interruption of electrical power to the power circuit 11 of that room. A third indicating lamp L1, which is red, is not energized in this operating state as there will be no power application to the input terminal 57 since the diode 53 in the secondary circuit 43 will prevent any such power transfer and no power will be obtained through the magnetic switch contacts 37*a* which are open at this time. A fourth lamp L4 which is of an amber color and located also on the desk clerk's control panel 20 is interconnected between the power source for the control circuit and the terminal 65 which is now in a HI state. Thus there will be an equal voltage between these two points and the lamp L4 will not be energized.

Next, assuming at this time a guest registers and is checked into the hotel, the desk clerk assigns the guest to a specific designated room. Concurrently, the desk clerk in the completion of the registration procedure will operate the push button switch PB2 to momentarily complete a circuit from the power source through a resistor 67 to an input Ia of the amplifier CDA2. This application of a signal to the amplifier results in a changing of the amplifier's operating state which causes its output terminal to then go to a LO state. With that terminal 65 then being in a LO state, the operating coil 50 of the reed relay would be deenergized and result in opening of its contacts 49. Accordingly, that circuit would be opened and deenergize the power relay solenoid 45 thus permitting the contacts 46 to close and complete the circuit to the electrical power circuit 11 of the room. Also, as a result of switching of the terminal 65 to a LO state, there will now be a voltage difference as to the amber light L4 which will now be energized and indicate to the desk clerk that electrical power is provided to that particular room. It will be noted that the green light L2 will remain energized and illuminated since the first amplifier CDA1 remains in its previously described operating state.

When the guest checks out of the hotel and turns in his room key to the desk clerk, the clerk will at that time operate the push button switch PB3 which simultaneously applies a signal to an input Ib of both amplifiers CDA1 and CDA2 through the respective resistors 68 and 69. The application of this control signal to both amplifiers will cause these amplifiers to switch to the opposite operating state and result in the terminal 64 going to a HI state and the terminal 65 of the second amplifier also going to a HI state. With the terminal 64 now being in a HI state, the green light L2 will be deenergized in the absence of any continued voltage difference but the red light L3 will now be energized through the resistor circuit including resistors 70 and 71. Thus, there will be a voltage difference as to lamp L3 which is connected through a diode 72 and a series connected pulse generator circuit 73 to the housekeeper's indicator lamp 15. That circuit terminates in a negative connection to the control circuit power source. Operation of this circuit is such that the pulse generator 73 will result in a periodic and intermittent flashing or energization of the lamp L3 at the desk clerk's panel 20 and the indicator lamp 15 at the housekeeper's station. This operation thus results in the indication to the housekeeper that the associated room is ready for cleaning prior to subsequent occupancy by a second registrant. Also, in this state of operation with the terminal 65 of the second amplifier CDA2 being in a HI state, the amber light L4 will be deenergized with the accompanying operation of the power control relay 41 to result in turning off or disconnection of the electrical power to that room as previously described. Specifically, this is achieved through the difference in power applied across the operating coil 50 of the relay switch 48 which thus closes its contacts and energizes the power relay solenoid 45.

Subsequent to the signalling of the housekeeper that the room is in need of cleaning through the flashing lamp 15, dispatch of the cleaning personnel to the room will result in those persons then inserting a key element 38 into the magnetic switch device 35 located in that room. The operation of this connection of the key element with the switch is such that the normally open contacts 37*a* will be closed and function to provide a voltage difference applied across the interconnecting diode 54 through the output terminal 55 and to the primary control circuit 23 at its input terminal 57. This application of the voltage difference results in illumination of the red lamp L1 located on the desk clerk's panel to indicate that the housekeeper or maid has now entered the room and is in the process of cleaning that room. Concurrently, a signal is then applied to an input terminal Ia of the first amplifier CDA1 which causes it to go to a LO state at the terminal 64. This results in deenergization of the circuit associated with the lamp L3 but again causes the green light L2 to become energized. In this situation, the desk clerk noting that both the steady red and steady green lights are illuminated will recognize that the room is not yet ready for occupancy but is in the process of being cleaned.

During the cleaning operation, once the maid has connected the key element to the switch device 35, power will be again supplied to the electrical power circuit 11 in that room as a consequence of the second amplifier CDA2 remaining in a HI state at the terminal 65. The secondary circuit 43 functions at this time to restore electrical power to the room as the terminal junction 60 will now also be at a corresponding HI voltage state and the operating coil 50 being interconnected between two similar voltage terminals will not be energized and result in opening of the reed relay switch contact 49 and deenergization of the power relay 41 permitting its contacts 46 to close.

When the maid has completed the cleaning operations and departs from the room, the key element 38 will then be removed from the switch device 35 which permits its contacts 37*a* to open. This operation then removes the HI voltage state as to the terminal junction 60 and also as to the input terminal 57 of the primary circuit 23. This causes the red lamp L1 to be deenergized and the reed relay operating coil 50 to be again energized and result in disconnecting electrical power to the room. At this time, it will be noted that the green light L2 has remained energized and, since it is the only lamp illuminated for that particular room on the desk clerk's control panel 20, it will indicate that the room is now ready for occupancy. This concludes a normal sequence of operations as to the circuit and a subsequent guest registration and check in will again initiate the operation.

In the event that the desk clerk should erroneously operate the push button PB2 or PB3, or that the conditions have changed such that the sequence must also be changed, the desk clerk may momentarily close the push button switch PB1. This switch, as can be seen by reference to FIG. 6, is fully equivalent to the condition where the maid enters the room and places the key element 38 in the magnetic switch 35. The system will then be operated in that same previously described sequence and when the switch PB1 is permitted to open will place the system in the condition of the room being ready for occupancy. The primary function of the switch PB1 in this circuit is to enable the desk clerk to reset the system in the event that an error was made in its operation or that it is desired to reinitiate the normal operating sequence.

Having thus described this invention, what is claimed is:

1. A hotel room status monitor and power control system for a hotel having a desk clerk station and a plurality of guest room units with each room unit having an electrical power circuit; the system comprising room power switch means interposed in circuit with an electrical power circuit of each respective room unit and an electrical power source, said switch means responsive to application of a switch control signal thereto to alternatively effect connection or disconnection of said power circuit with respect to the electrical power source, respective room input signal means located within each room unit, each of said signal means selectively operable to provide a room input control signal, control circuit means connected with said room power switch means and said room input signal means for each respective room unit, said control circuit means including room status indicating means located at the desk clerk station for providing indications of a plurality of room status conditions and first and second electrical switch means which are each selectively operable to provide respective first and second input switch signals to said control circuit means, said control circuit means responsive to the application thereto of first and second input switch signals and room input control signals to effect operation of said room status indicating means in providing an indication of a selected one of the plurality of room status conditions and to provide a switch control signal to said room power switch means to effect either connection or disconnection of said power circuit in accordance with a predetermined relationship to the selected room status condition.

2. A room status monitor and power control system according to claim 1 wherein said control circuit means responds to (1) a first input switch signal produced by operation of said first switch means to operate said room status indicating means to provide a first one of the room status indications and to provide a switch control signal to said room power switch means to effect connection of the room electrical power circuit to the electrical power source; or (2) a second input switch signal produced by operation of said second switch means to operate said room status indicating means to provide a second one of the room status indications and to provide a switch control signal to said room power switch means to effect disconnection of the room electrical power circuit from the electrical power source.

3. A room status monitor and power control system according to claim 1 wherein said control circuit means, having responded to a second input switch signals, responds to application of a room input control signal to operate said room status indicating means to provide a third one of the room status indications and to provide a switch control signal to said room power switch means to effect connection of the room electrical power circuit to the electrical power source.

4. A room status monitor and power control system according to claim 1 wherein said control circuit means, having responded to application of a room input control signal, responds to removal of a room input control signal to operate said room status indicating means to provide a fourth one of the room status indications and to provide a switch control signal to said room power switch means to effect disconnection of the room electrical power circuit from the electrical power source.

5. A room status monitor and power control system according to claim 3 which includes at least one other indicating means disposed at a location relatively remote to the desk clerk station and operable to provide the third one of the room status indications at the remote location.

6. A room status monitor and power control system according to claim 1 wherein said room power switch means is an electrically operated relay switch which includes an electrical operating solenoid and an electrically isolating control switch connected in circuit with said solenoid, said isolating control switch responsive to the switch control signal provided by said control circuit means.

7. A room status monitor and power control system according to claim 6 wherein said electrically isolating control switch is a magnetic field responsive reed switch including a magnetic field generating coil.

8. A room status monitor and power control system according to claim 1 wherein said room input signal means is a magnetic field actuated switch located in a respective room and is selectively operable to provide an input control signal in the form of the presence or absence of electrical voltage.

* * * * *

UNITED STATES PATENT OFFICE

CERTIFICATE OF CORRECTION

Patent No. 4,194,181 Dated March 18, 1980

Inventor(s) Bert W. Brundage

It is certified that error appears in the above-identified patent and that said Letters Patent are hereby corrected as shown below:

Column 14, line 21, cancel "1" and insert --2-- line 30, cancel "1" and insert --3--

Signed and Sealed this

*Seventeenth* Day of *June 1980*

[SEAL]

*Attest:*

SIDNEY A. DIAMOND

*Attesting Officer*

*Commissioner of Patents and Trademarks*